US007992859B2

(12) United States Patent
Shiina

(10) Patent No.: US 7,992,859 B2
(45) Date of Patent: Aug. 9, 2011

(54) SHEET FEEDING APPARATUS AND IMAGE FORMING APPARATUS

(75) Inventor: Sachiyori Shiina, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 274 days.

(21) Appl. No.: 12/467,496

(22) Filed: May 18, 2009

(65) Prior Publication Data

US 2009/0295069 A1 Dec. 3, 2009

(30) Foreign Application Priority Data

May 30, 2008 (JP) ..... 2008-142497

(51) Int. Cl.
*B65H 3/06* (2006.01)

(52) U.S. Cl. ..... 271/109

(58) Field of Classification Search ..... 271/109
See application file for complete search history.

(56) References Cited

U.S. PATENT DOCUMENTS

| | | | | |
|---|---|---|---|---|
| 6,025,936 | A * | 2/2000 | Ishida | 358/498 |
| 6,488,276 | B2 * | 12/2002 | Sheng et al. | 271/18 |
| 7,913,996 | B2 * | 3/2011 | Nishikata et al. | 271/162 |
| 2007/0145666 | A1 * | 6/2007 | Nishikata et al. | 271/18 |

FOREIGN PATENT DOCUMENTS

| | | |
|---|---|---|
| JP | 2004-256287 | 9/2004 |
| JP | 2007-176621 | 7/2007 |

* cited by examiner

*Primary Examiner* — Gerald W McClain
(74) *Attorney, Agent, or Firm* — Fitzpatrick, Cella, Harper & Scinto

(57) ABSTRACT

A slide restricting member for restricting detachment of a feed roller which is rotatably supported and which is detachably held in an axial direction is held at a lock release position for allowing the detachment of the feed roller by a rib of a sheet feeding frame, a projection of an auxiliary member, and a snap fit. When the feed roller is mounted on the sheet feeding frame, the slide restricting member positioned at the lock release position is moved to a lock position in conjunction with a mounting operation of the feed roller.

8 Claims, 9 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and more particularly, to a sheet feeding apparatus including a detachably-mounted feed roller for feeding a sheet.

2. Description of the Related Art

Conventionally, in an image forming apparatus such as a printer, a copying machine, or a facsimile machine, there is provided a sheet feeding apparatus for separating and feeding sheets one by one from a sheet stacking unit in which multiple sheets are stacked. In the sheet feeding apparatus, there is provided a feed roller for feeding the uppermost sheet among the stacked sheets. However, there is a possibility that an outer peripheral surface of the feed roller may deteriorate after being used for a long time due to abrasion or the like, causing a decrease in feeding performance. For this reason, the feed roller is made to be detachable from the sheet feeding apparatus so as to be periodically replaced with ease.

In order to facilitate replacement work of the feed roller by a user or a service person, there is conventionally known a sheet feeding apparatus having a structure in which the feed roller is made into a unit, and one shaft and a main body of the feed roller can make a slide movement relative to each other. With the above-mentioned structure, the main body of the feed roller is caused to relatively slide with respect to the one shaft, and engagement with the shaft of the apparatus main body is released, whereby the feed roller can be detached. The above-mentioned structure is described in Japanese Patent Application Laid-Open No. 2004-256287.

However, the structure in which the feed roller is replaced in a slide system has the following problems.

(1) When a jam is caused in a state where a sheet is nipped between the feed roller and a sheet separating unit (separating pad or separating roller), a problem arises in a case of the jam recovery. In this case, bending or slacking of the jammed sheet is caught at an end of the feed roller, and thus the feed roller is caused to slide unnecessarily.

(2) When a mounting direction of a sheet feeding cassette is the same as a slide direction of the feed roller, a problem arises in the case where a jam is caused in a state where the sheet is nipped between the feed roller and the sheet separating unit. In this case, the jammed sheet causes the feed roller to slide if the sheet feeding cassette is drawn out.

(3) When an unexpected large force is exerted when being transported, the feed roller is detached.

In the case where the feed roller is reluctantly detached under the above-mentioned circumstances for the above-mentioned reasons, the sheet cannot be fed out, and thus the sheet feeding apparatus is judged that a failure has occurred.

In order to prevent the feed roller from being detached reluctantly, it is conceivable to provide a lock member for restricting slide movement of the feed roller. When the lock member is provided, in replacing the feed roller, the user manually switches the lock member from a lock position to a lock release position, and then replaces the feed roller. After the feed roller is replaced, the lock member is manually switched from the lock release position to the lock position.

When the lock member is provided, however, there may be a case where the user forgets to switch the lock member from the lock release position to the lock position after replacing the feed roller. In this case, feed roller is, for example, deviated or detached during feeding the sheet by the feed roller, leading to a feeding malfunction.

In order to solve the above-mentioned problems, there is known a sheet feeding apparatus in which a pivotal lock lever is provided as a lock member in a vicinity of the feed roller. In this case, even when the user forgets to switch the lock member to the lock position, the lock lever is pivoted as a result of mounting of the sheet feed cassette and is switched to the lock position automatically. This technology is described in Japanese Patent Application Laid-Open No. 2007-176621.

There is known a conventional sheet feeding apparatus in which the feed roller is replaced from the use of other opening or closing door without detaching the sheet feeding cassette. In this sheet feeding apparatus, the feed roller is replaced while the sheet feeding cassette is not attached or detached. Therefore, the lock member is not reset to the lock state by the sheet feeding cassette in the case where the user forgets to return the lock lever.

The above-mentioned structure is not provided with a countermeasure which is taken when the user forgets to set the lock lever to the lock position after the feed roller is replaced.

SUMMARY OF THE INVENTION

The present invention has been made under the circumstances as described above, and therefore provides a sheet feeding apparatus and an image forming apparatus which are capable of reliably switching a lock member to a lock position after a feed roller is changed.

A sheet feeding apparatus according to the present invention comprises: a feed roller which is detachably provided on the sheet feeding apparatus and which feeds a sheet; a supporting portion which detachably supports the feed roller in an axial direction; a lock member which is movable between a lock position where the detachment of the feed roller is restricted and a lock release position where the detachment of the feed roller is allowed; a holding portion which holds the lock member that has moved to the lock release position; and a moving mechanism which moves the lock member held at the lock release position by the holding portion to the lock position in conjunction with a mounting operation of the feed roller when the feed roller is mounted on the supporting portion.

Further features of the present invention become apparent from the following description of exemplary embodiment with reference to the attached drawings.

DESCRIPTION OF THE EMBODIMENTS

Hereinafter, an embodiment of the present invention is described in detail with reference to the drawings.

Figure 1:
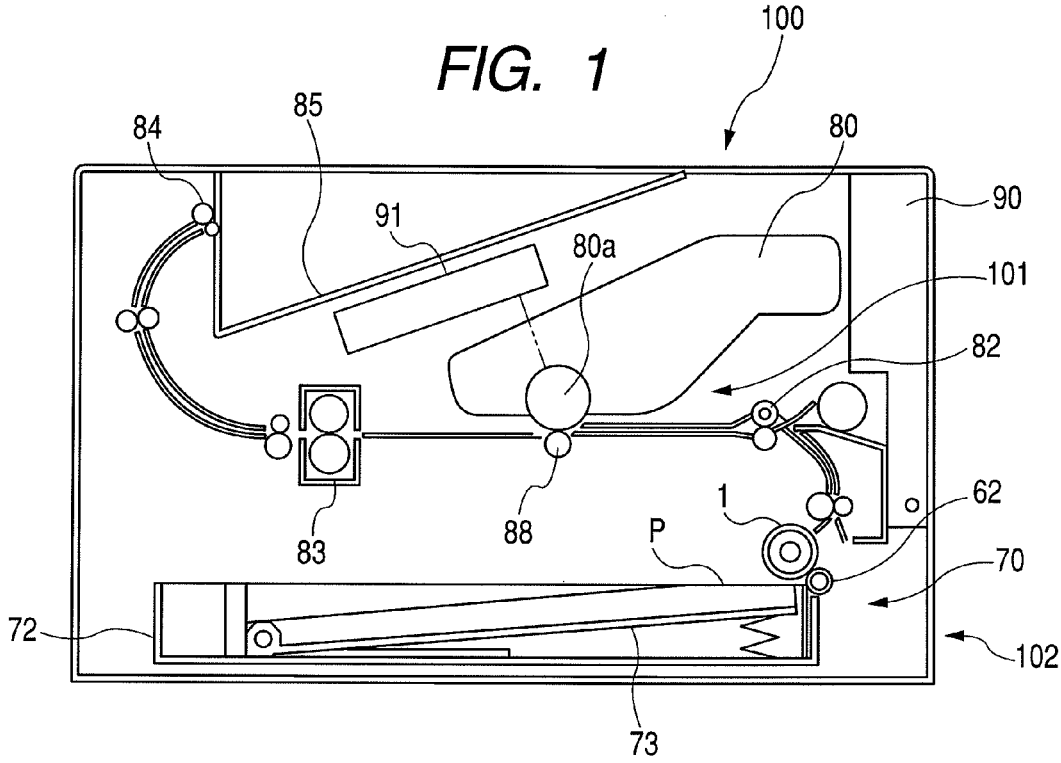
FIG. 1 illustrates a schematic structure of a laser printer as an example of a sheet feeding apparatus and an image forming apparatus according to a first example of the present invention.

FIG. 1 illustrates a schematic structure of a laser printer as an example of a sheet feeding apparatus and an image forming apparatus including the sheet feeding apparatus according to a first example of the present invention.

With reference to FIG. 1, a sheet feeding apparatus 102 for feeding a sheet to an image forming portion 101 is provided in a lower portion of a laser printer main body 100 (hereinafter, referred to as apparatus main body).

The image forming portion 101 includes a cartridge unit 80 which includes a photosensitive drum 80*a* serving as an image bearing member, and a laser scanner 91 for exposing the photosensitive drum 80*a*. In the case of image formation, the photosensitive drum 80*a* is exposed by the laser scanner 91, and a latent image is formed on a surface of the photosensitive drum 80*a*. Then, the latent image is developed, whereby a toner image is formed on the surface of the photosensitive drum 80*a*.

The sheet feeding apparatus 102 includes a sheet feeding cassette 70 which is detachably provided in the apparatus main body 100 and serves as a sheet stacking portion. The sheet feeding apparatus 102 includes a feed roller 1 which is provided above the sheet cassette 70 and feeds a sheet P accommodated in the sheet feeding cassette 70. The cassette 70 includes a plate 73 for pressing the sheet P against the feed roller side, which is provided to be capable of lifting and lowering. The plate 73 is held at a position at which the sheet P is pressed against the feed roller side by a lifting and lowering mechanism (not shown) in the case of a sheet feeding movement, and is pivoted downward when a right door 90 is opened for, for example, supply of the sheet.

The sheet feeding apparatus 102 includes a separating roller 62 serving as a sheet separating unit for pressure contacting with the feed roller 1, and for separating the sheet P fed by the feed roller 1. In this example, the apparatus main body 100 forms a sheet feeding apparatus main body.

The sheet feeding apparatus 102 feeds the sheet P accommodated in the sheet feeding cassette 70 by the feed roller 1 in conjunction with a toner image forming operation of the image forming portion 101. Then, the sheet feeding apparatus 102 separates the sheet P by the separating roller 62 one by one. After that, the sheet P is conveyed to a transfer portion including the photosensitive drum 80*a* and a transfer roller 88 by a pair of registration rollers 82 at a predetermined timing.

The toner image which is formed on the surface of the photosensitive drum 80*a* in the transfer portion is transferred to the sheet P conveyed to the transfer portion. Then, the sheet P is conveyed to a fixing device 83, and heated and pressurized in the fixing device 83, whereby the toner image is fixed. After the image is fixed, the sheet P is delivered to a delivery portion 85 provided on an upper surface of the apparatus main body 100 by a pair of delivery rollers 84.

Figure 2:
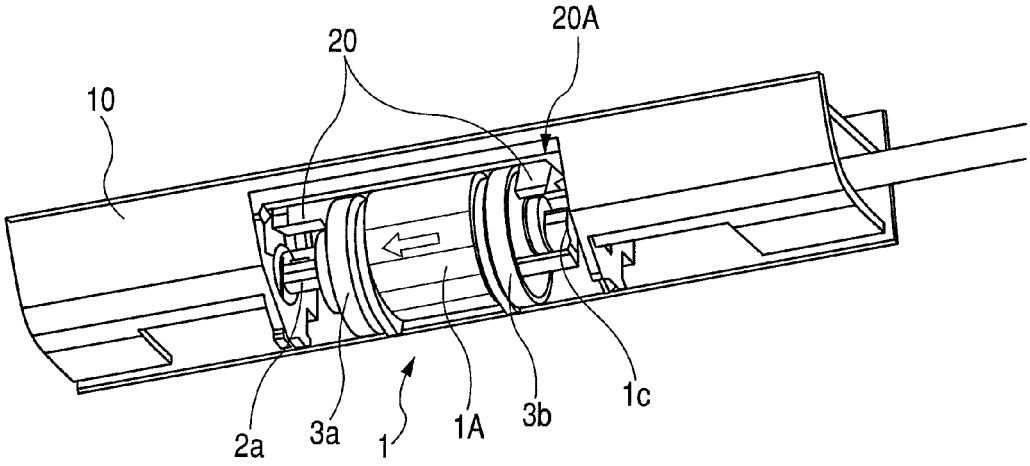
FIG. 2 illustrates a structure of a feed roller of the sheet feeding apparatus.

FIG. 2 illustrates a structure of a feed roller of the sheet feeding apparatus according to this example. As illustrated in FIG. 2, the unitized feed roller 1 is rotatably supported by a sheet feeding frame 10 which is provided in the sheet feeding apparatus main body and serves as a support portion. The feed roller 1 is provided with a first roller shaft 2*a* at one end thereof, and a convex fitting shaft 1*c* serving as a second roller shaft at the other end thereof. A roller main body 1A is slidable in a direction indicated by an arrow (axial direction) along the first roller shaft 2*a*.

A lock mechanism 20A provided in a vicinity of the feed roller 1 has a function of switching a slide movement of the feed roller 1 in the direction indicated by the arrow between permitted or prohibited. The lock mechanism 20A includes a slide restricting member 20 which projects above the shafts 2*a* and 1*c* on both sides of the feed roller 1 in the normal sheet feeding movement. The slide restricting member 20 is a movable lock member which restricts the slide movement of the feed roller 1.

Figure 3A:
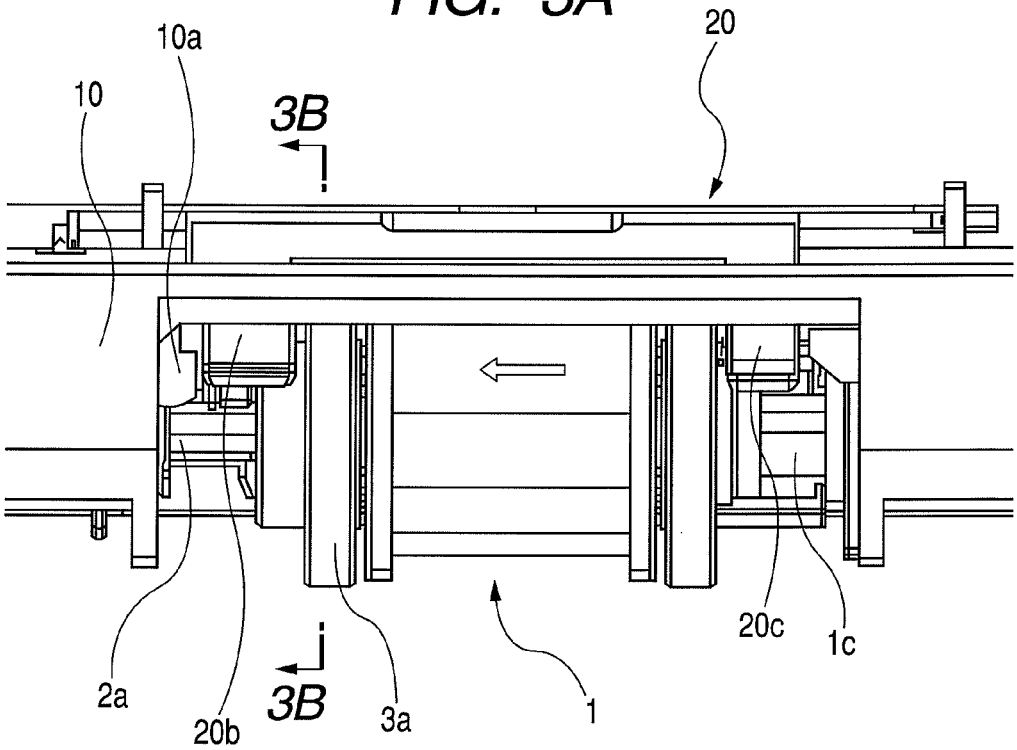
FIGS. 3A and 3B illustrate a lock mechanism which is provided in the sheet feeding apparatus and restricts a slide movement of the feed roller.
Figure 3B:
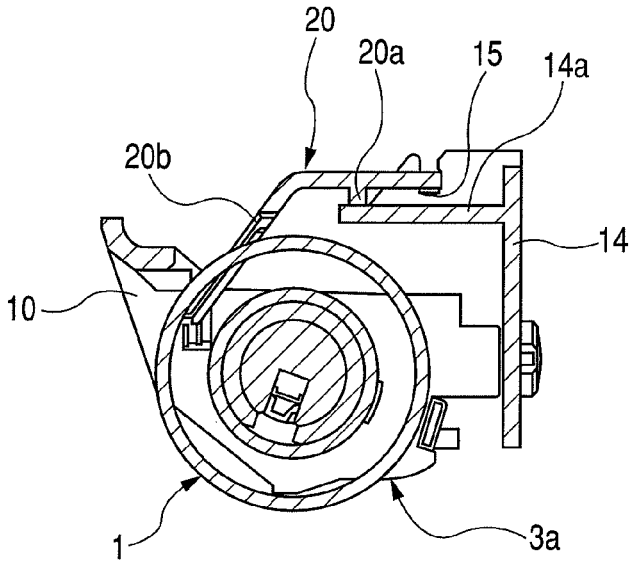

FIG. 3A illustrates a slide restriction state in which the slide restricting member 20 is positioned at a lock position for restricting detachment of the feed roller 1. FIG. 3B which is a cross-section drawing taken along the line 3B-3B of FIG. 3A illustrates a positional relationship between the feed roller 1 and the slide restricting member 20 in a radial direction. When the slide restricting member 20 is in the slide restriction state, as illustrated in FIG. 3B, a bumping rib 20*a* of the slide restricting member 20 bumps a bumping surface 14*a* of an auxiliary member 14 which is provided to the sheet feeding frame 10. Accordingly, a posture of the slide restricting member 20 is determined.

In FIGS. 3A and 3B, a rib 10*a* is provided to the sheet feeding frame 10. When the slide restricting member 20 is in the slide restriction state, a first projecting portion 20*b*, which is a leading end portion of the slide restricting member 20, is present between the rib 10*a* and a first conveying rotatable member 3*a* of the feed roller 1.

When the feed roller 1 is caused to slide in the direction indicated by the arrow, which is a detachment direction, the first conveying rotatable member 3*a* bumps the first projecting portion 20*b* of the slide restricting member 20 on the slide direction side of the feed roller 1. A position of the first projecting portion 20*b* is determined by bumping the first projecting portion 20*b* into the rib 10*a* of the sheet feeding frame 10. Accordingly, the slide movement of the feed roller 1 can be restricted. The slide restricting member 20 includes a second projecting portion 20*c* positioned between the sheet feeding frame 10 and the first conveying rotatable member 3*a*. The first projecting portion 20*b* serving as a restricting member is provided on the detachment direction side of the feed roller 1 with respect to the second projecting portion 20*c*.

Figure 4A:
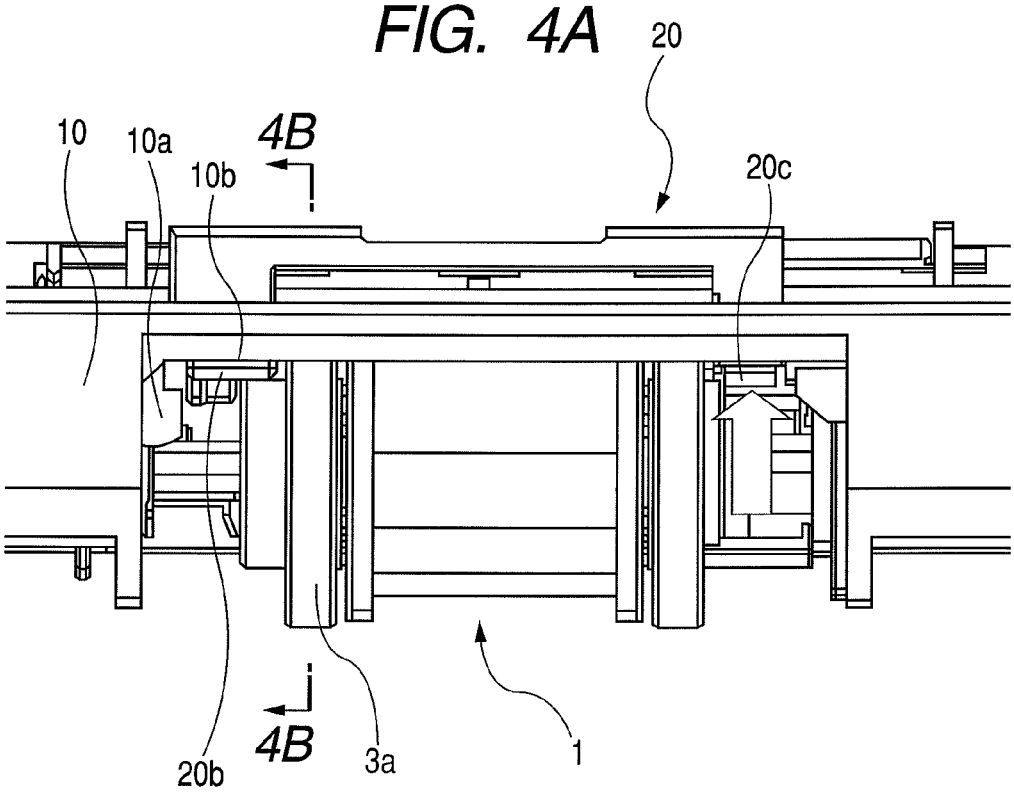
FIGS. 4A and 4B illustrate a lock release operation of the lock mechanism.

The slide restricting member 20 can be pivoted in a vertical direction with a pivotal supporting portion 15 provided to the auxiliary member 14 as illustrated in FIG. 3B. In the case where the feed roller 1 is detached, one of the first and second projecting portions 20*b* and 20*c*, for example, the second projecting portion 20*c* located on the opposite side of the detachment direction is pushed up in a direction indicated by an arrow of FIG. 4A.

Figure 4B:
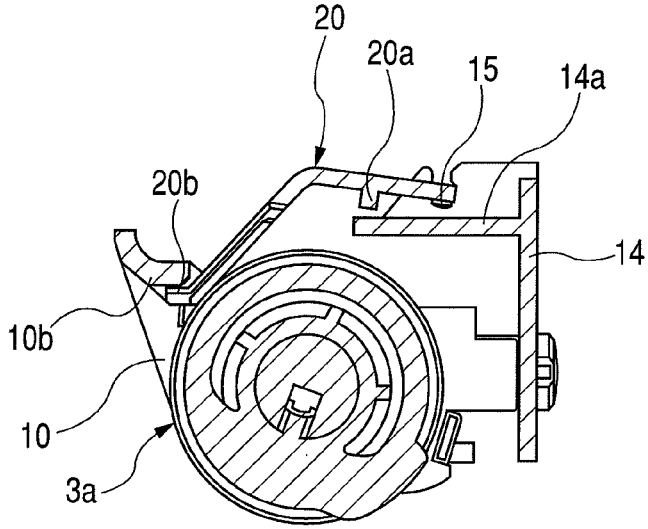

When the second projecting portion 20*c* is pushed up by manual operation, the slide restricting member 20 is pivoted upward. As illustrated in FIG. 4B corresponding to a cross-section drawing taken along the line 4B-4B of FIG. 4A, the slide restricting member 20 is pivoted until a pivotal end of the first projecting portion 20*b* abuts against a stopper portion 10*b* having a cut-away shape, which is provided to the sheet feeding frame 10.

Figure 5:
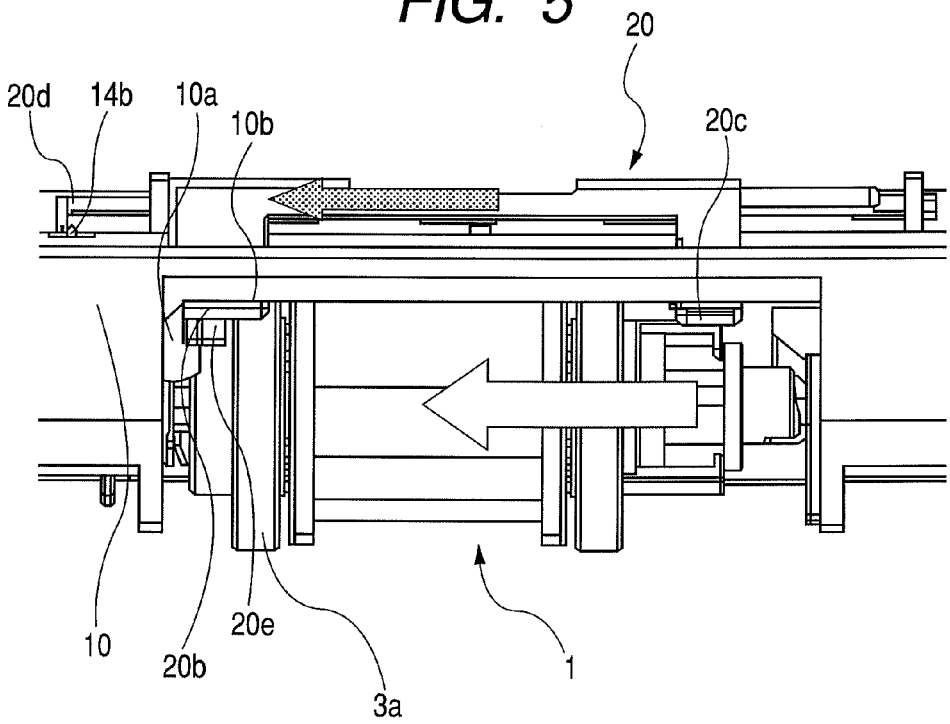
FIG. 5 illustrates a structure in which a slide restricting member is moved integrally with the feed roller after a lock of the lock mechanism is released.

As illustrated in FIG. 4B, the stopper portion 10*b* is provided at a position at which the first projecting portion 20*b* and the first conveying rotatable member 3*a* do not overlap with each other when the pivotal end of the first projecting portion 20*b* abuts. The slide restricting member 20 is moved to the lock release position, and thereafter, the feed roller 1 can be caused to slide in a direction indicated by an arrow (axial direction) illustrated in FIG. 5.

The stopper portion 10*b* is provided at a position at which the first projecting portion 20*b* is located above the rib 10*a* of the sheet feeding frame 10 when the pivotal end of the first projecting portion 20*b* abuts. Accordingly, the slide restricting member 20 can move in the same direction as the slide direction of the feed roller 1.

The slide restricting member 20 is provided with a rib 20*e*. The rib 20*e* abuts against the first conveying rotatable member 3*a* of the feed roller 1 when the feed roller 1 slides in a direction indicated by an arrow illustrated in FIG. 5 along the first roller shaft 2*a*. When the feed roller 1 is caused to slide, the first conveying rotatable member 3*a* abuts against the rib 20*e* of the slide restricting member 20, and the slide restricting member 20 also moves integrally with the feed roller 1.

Through the above-mentioned movement, the projecting portion 20*b* of the slide restricting member 20 runs on the rib 10*a* of the sheet feeding frame 10. As a result, the downward pivot of the slide restricting member 20 is restricted. A snap fit 20*d* is provided to the slide restricting member 20, and a projection 14*b* is provided to the auxiliary member 14 on a downstream side in the slide direction.

The snap fit 20*d* and the projection 14*b* form a fixing portion for fixing the slide restricting member 20 held by the rib 10*a* of the sheet feeding frame 10, which serves as a holding member. The slide restricting member 20 is moved, and then the snap fit 20*d* is engaged with the projection 14*b* of the auxiliary member 14, whereby the slide restricting member 20 is fixed.

In this example, the snap fit 20*d*, the projection 14*b* provided to the auxiliary member 14, and the rib 10*a* of the sheet feeding frame 10 form the holding portion for holding the slide restricting member 20 which has moved to the lock release position.

The holding portion is provided, and thus the slide restricting member 20 is held when the feed roller 1 is caused to slide after the upward pivot of the slide restricting member 20. The slide restricting member 20 is held at a position at which attachment and detachment of the feed roller 1 are not prevented in any one of the pivot direction and the slide direction. As a result, the feed roller 1 can be attached and detached smoothly.

Next, a mounting operation of the replaced feed roller 1 is described.

Figure 6:
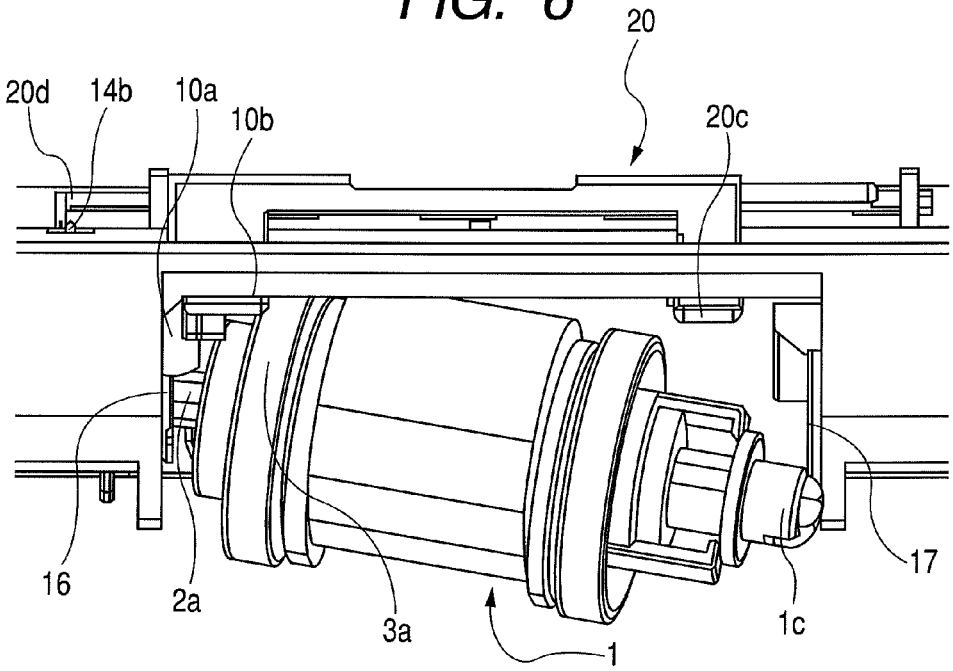
FIG. 6 illustrates a mounting movement of the feed roller.

When the feed roller 1 is mounted as illustrated in FIG. 6, the feed roller 1 is mounted while the first roller shaft 2*a* of the feed roller 1 is compressed to conform a bearing 16 so that the convex fitting shaft 1*c* forming the second roller shaft fits into a bearing 17. The feed roller 1 is mounted, and thereafter, the feed roller 1 is caused to slide by a spring force in a direction indicated by an arrow illustrated in FIG. 7A.

Figure 7A:
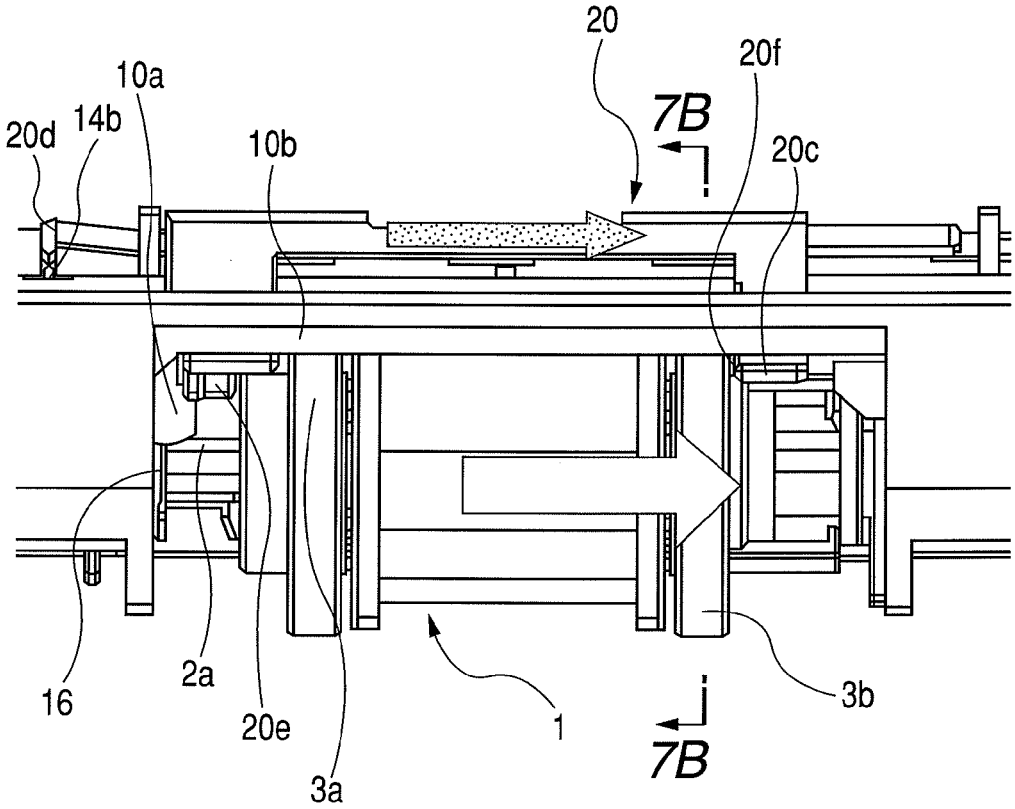
FIGS. 7A and 7B illustrate a state of the lock mechanism when the feed roller is mounted.
Figure 7B:
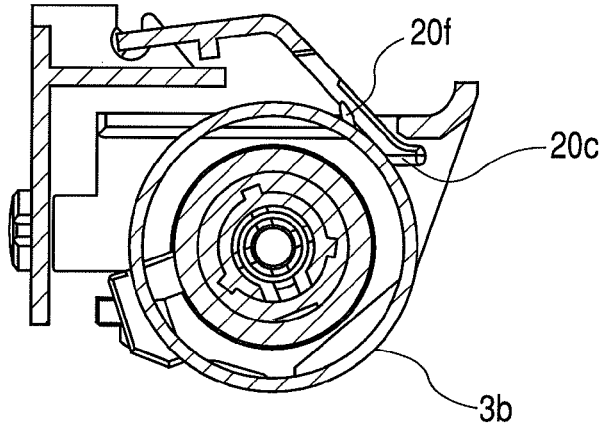

As illustrated in FIG. 7B which illustrates a cross-section taken along the line 7B-7B of FIG. 7A, in this case, the second projecting portion 20*c* of the slide restricting member 20 is located at a position at which the second projecting portion 20*c* interferes with the first conveying rotatable member 3*b* in a radial direction. A projecting portion 20*f* serving as an engaging portion is provided to the second projecting portion 20*c*. The projecting portion 20*f* abuts against the first conveying rotatable member 3*a* serving as an abutment portion of the feed roller 1 when the feed roller 1 slides in a mounting direction opposite to the detachment direction.

The first conveying rotatable member 3*a* and the projecting portion 20*f* of the second projecting portion 20*c* form a moving mechanism. When the feed roller 1 is mounted, the moving mechanism moves the slide restricting member 20, which is held at the lock release position by the holding portion in conjunction with the mounting operation of the feed roller 1, to the lock position.

A force for engaging the snap fit 20*d* of the slide restricting member 20 with the projection 14*b* of the auxiliary member 14 is set to be smaller than a returning force of a spring of the feed roller 1. The feed roller 1 is caused to slide in the mounting direction, whereby the first conveying rotatable member 3*a* abuts against the projecting portion 20*f* of the slide restricting member 20, and the slide restricting member 20 also moves integrally with the feed roller 1. The snap fit 20*d* is pushed back by the returning force of the spring of the feed roller 1 and goes over the projecting portion 14*b* of the auxiliary member 14. Thus, the holding by the holding portion of the slide restricting member 20 is released.

When the holding by the slide restricting member 20 is released, the rib 20*e* of the slide restricting member 20 is detached from the rib 10*a* of the sheet feeding frame 10 on the way while the feed roller 1 is returning to a position for performing sheet feeding movement. Accordingly, the slide restricting member 20 is pivoted downward by gravity, to thereby return to the slide restriction state, that is, the lock position.

The feed roller 1 is mounted on the sheet feeding frame 10, whereby the slide restricting member 20 slides as well by a spring force (returning force) of the feed roller 1. The slide restricting member 20 is detached from the rib 10*a* of the sheet feeding frame 10, and is pivoted downward by gravity. As a result, the slide restricting member 20 can be returned to the slide restriction state.

In this example, when the feed roller 1 is mounted, the slide restricting member 20 located at the lock release position can be moved to the lock position in conjunction with the mounting operation of the feed roller 1.

Accordingly, irrespective of the attachment and detachment of the sheet feeding cassette, only with mounting of the feed roller 1, the slide restricting member 20 can be automatically returned to the lock position even when the slide restricting member 20 is located at the lock release position. As a result, the slide restricting member 20 can be reliably switched to the lock position after the feed roller is replaced. Further, the slide restricting member 20 can be automatically returned without fail when the feed roller is replaced by a user access portion other than the sheet feeding cassette, which enables the sheet feeding apparatus to take various structures according to this example.

Next, a second example of the present invention is described.

Figure 8:
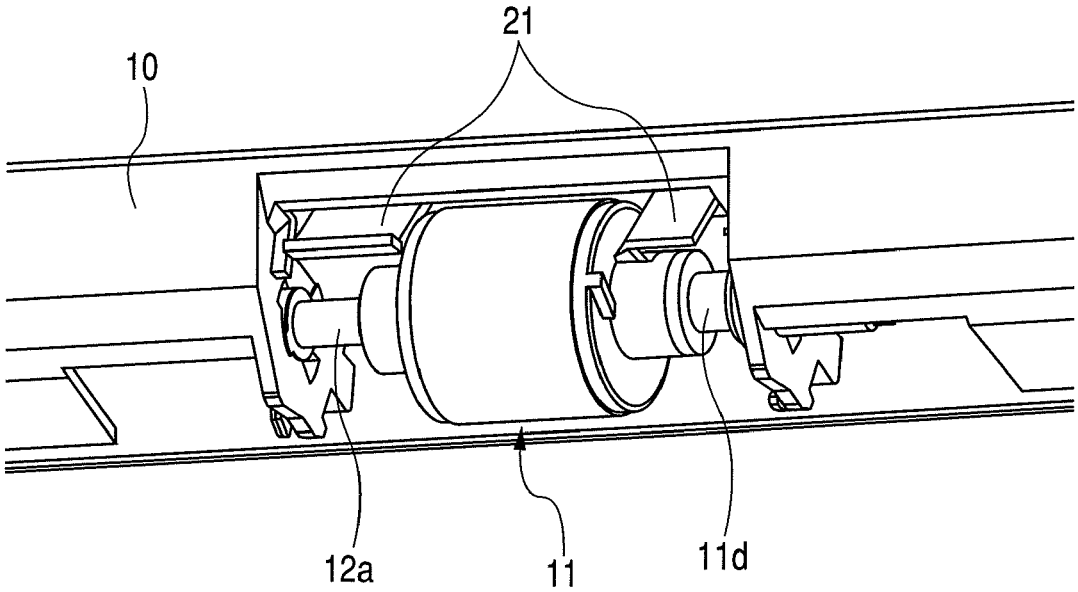
FIG. 8 illustrates a structure of a sheet feeding apparatus according to a second example of the present invention in a vicinity of a feed roller.

FIG. 8 illustrates a structure of a sheet feeding apparatus in a vicinity of a feed roller according to this example.

With reference to FIG. 8, a slidable first roller shaft 12*a* is provided to a feed roller 11 having no cut-away portion. The feed roller 11 is detachable from the sheet feeding frame 10 by expanding and contracting the first roller shaft 12*a*.

Figure 9A:
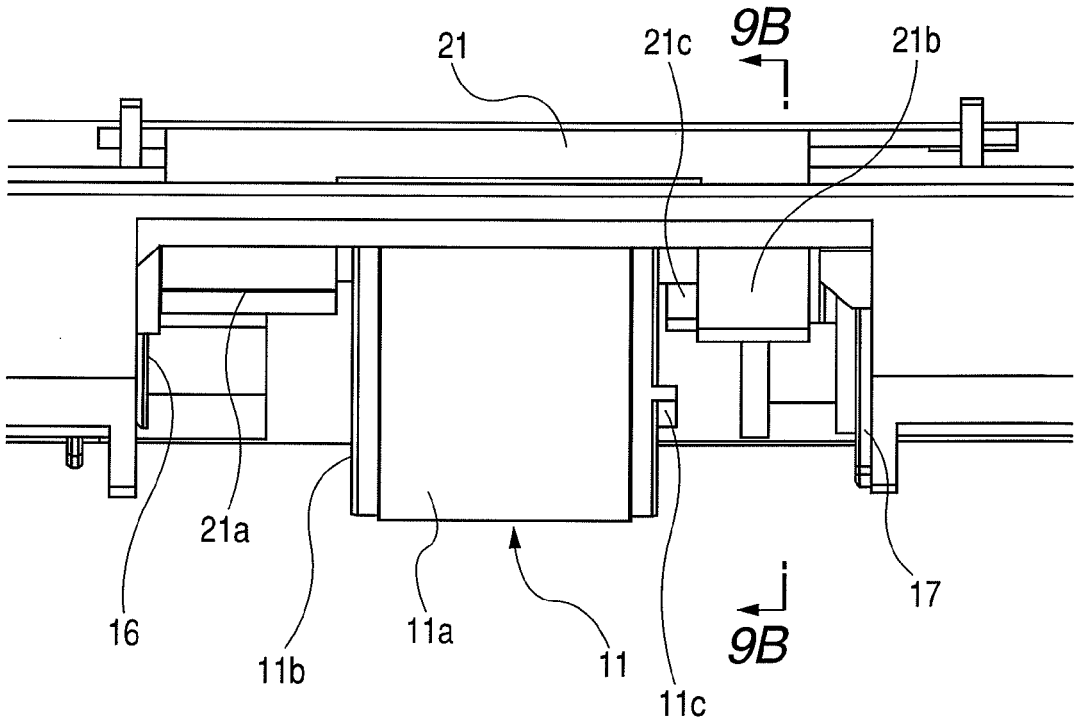
FIGS. 9A and 9B illustrate a lock mechanism which is provided in the sheet feeding apparatus and restricts a slide movement of the feed roller.
Figure 9B:
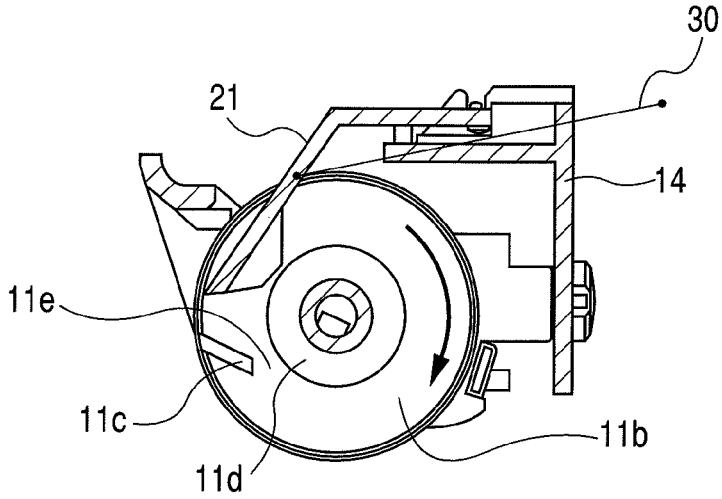

A slide restricting member 21 for restricting a slide movement of the feed roller 11 is rotatably (movably) held by the auxiliary member 14 illustrated in FIGS. 9A and 9B. The slide restricting member 21 is pivoted from a restriction position (lock position) for restricting the slide movement of the feed roller 11 when the sheet feeding is operated as illustrated in FIGS. 9A and 9B to the detachment position (lock release position) for enabling the feed roller 11 to be detached as illustrated in FIGS. 10A and 10B.

In this example, the slide restricting member 21 is held at the restriction position by a toggle mechanism forming a holding portion which includes an elastic member 30 such as a spring. Meanwhile, when the slide restricting member 21 moves to the detachment position, the slide restricting member 21 is held at the detachment position by the toggle mechanism. That is, the slide restricting member 21 is held at one of the restriction position and the detachment position by the toggle mechanism.

In this example, in the case where the feed roller 11 is detached, the slide restricting member 21 is pivoted upward. The slide restricting member 21 is located at the restriction position illustrated in FIG. 9A before being pivoted upward. In this case, as illustrated in FIG. 9B which is a cross-section drawing taken along the line 9B-9B of FIG. 9A, a first projecting portion 21*a* overlaps a feed roller core 11*b* in a radial direction. For this reason, the feed roller 11 is not detached inadvertently.

Figure 10A:
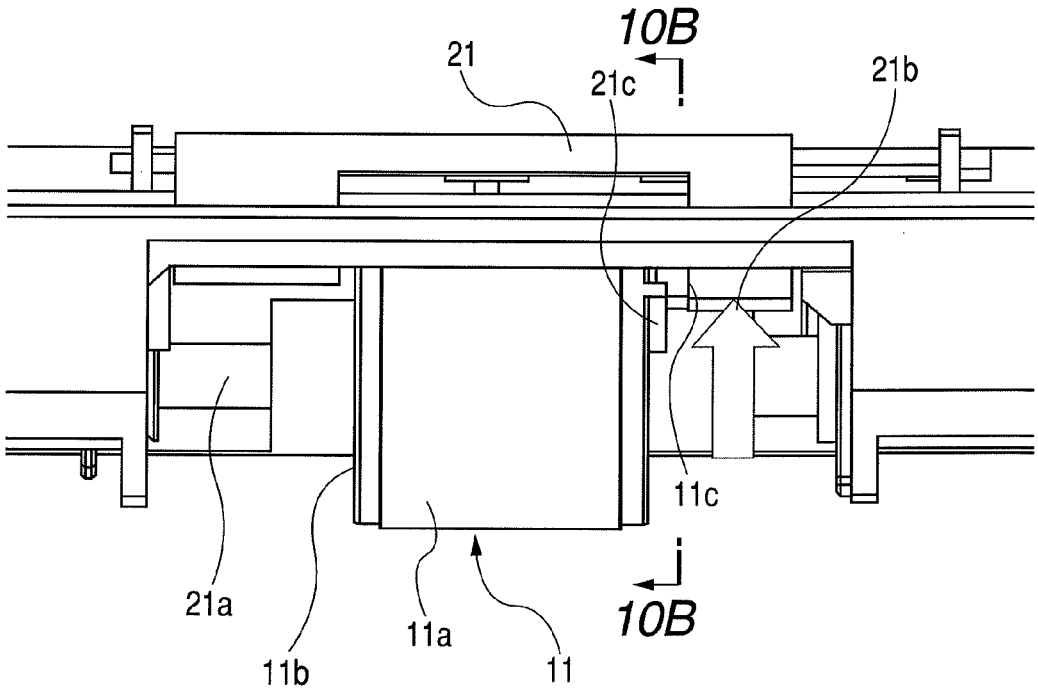
FIGS. 10A and 10B illustrate a lock release operation of the lock mechanism.
Figure 10B:
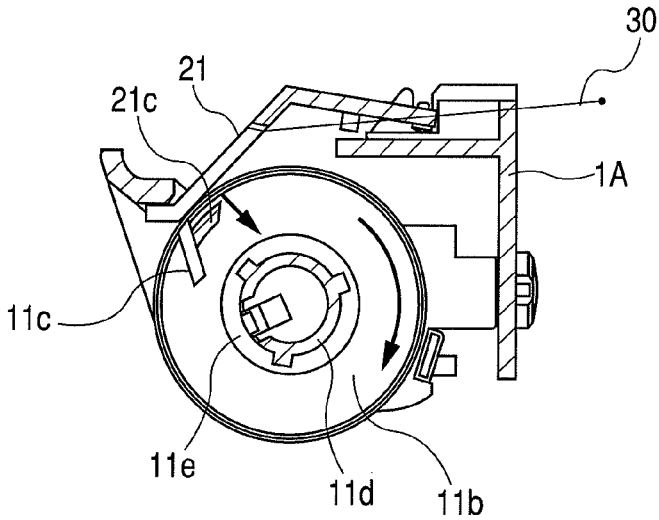

Next, as illustrated in FIG. 10A, one of the first projecting portion 21*a* and a second projecting portion 21*b*, for example, the second projecting portion 21*b* on the opposite side of the detachment direction is pushed up in a direction indicated by an arrow. When the second projecting portion 21*b* is pushed up, the slide restricting member 21 is pivoted upward and moved to the restriction release position, and then is held at the detachment position by the toggle mechanism.

When the slide restricting member 21 is held by the toggle mechanism, as illustrated in FIG. 10B which is a cross-section drawing taken along the line 10B-10B of FIG. 10A, a pivotal end of the first projecting portion 21*a* is moved to a position at which the pivotal end retracts from a slide trajectory of the feed roller 11. Accordingly, the feed roller 11 is slidable to a position at which the feed roller 11 is detached from the sheet feeding frame 10, which enables the attachment and detachment of the feed roller 11.

The feed roller 11 is detached after the slide restricting member 21 is pivoted and held at the detachment position by the toggle mechanism, and then, a replaced feed roller 11 is mounted. In this case, the feed roller 11 is mounted while the fist roller shaft 12*a* is contracted with a leading end of the first roller shaft 12*a* of the feed roller 11 being aligned with the bearing 16 so that a coupling lid is fitted into the bearing 17.

In this example, a projecting portion 11*c* serving as an abutment portion is provided on a side surface of a roller core 11*b* of the feed roller 11. In addition, a rib 21*c* serving as an engagement portion is provided to the second projecting portion 21*b* of the slide restricting member 21. In this example, the projecting portion 11*c* and the rib 21*c* of the second projecting portion 21*b* form a moving mechanism. The moving mechanism moves the slide restricting member 21 which, to the lock position, is held at the lock release position in synchronization with the mounting operation of the feed roller 11 in the case where the feed roller 11 is mounted.

The projecting portion 11*c* of the feed roller 11 and the rib 21*c* of the second projecting portion 21*b* are provided in a positional relationship in which the projecting portion 11*c* abuts against the rib 21*c* in the trajectory in which the feed roller 11 is rotated once. In the case where the feed roller 11 is mounted, that is, in the state where the feed roller 11 is at a home position, the projecting portion 11*c* of the feed roller 11 is at a position illustrated in FIG. 9B. When the sheet feeding movement is started, the projecting portion 11*c* is also rotated clockwise along with the rotation of the feed roller 11, and abuts against the rib 21*c* of the slide restricting member 21 as illustrated in FIG. 10B.

The rib 21*c* is formed so that a force is applied inward in a radial direction of the feed roller 11 when the projecting portion 11*c* abuts against the rib 21*c*. The force applied to the rib 21*c* in this case is set to be larger than a holding force of the toggle mechanism.

For this reason, the force for pivoting the slide restricting member 21 downward is exerted on the slide restricting member 21 when the projecting portion 11*c* abuts against the rib 21*c*. This force is larger than the holding force of the toggle mechanism, and hence the slide restricting member 21 is pivoted downward. Accordingly, the slide restricting member 21 is moved from the detachment position (lock release position) to the restriction position (lock position). After the movement to the restriction position, the slide restricting member 21 is held at the restriction position by the toggle mechanism, whereby the feed roller 11 is not detached.

When the slide restricting member 21 is at the restriction position, as illustrated in FIG. 9B, the rib 21*c* of the slide restricting member is in a positional relationship in which the rib 21*c* passes through a cut-away portion lie between the projecting portion 11*c* and the shaft portion lid of the roller core 11*b*. For this reason, there is no effect on the rotation of the feed roller 11.

When the sheet feeding movement is started and the feed roller 11 is rotated once after the mounting of the feed roller 11, the feed roller 11 abuts against the rib of the slide restricting member 21 being in the restriction release state, with the result that the slide restricting member 21 is pivoted downward. Accordingly, the slide restricting member 21 is pressed against the feed roller 11, and returns to the restriction position from the detachment position.

That is, in this example, the slide restricting member 21, which is held at the detachment position by the holding portion in synchronization with the rotating movement after the feed roller 11 is mounted, is moved to the restriction position. Accordingly, when the slide restricting member 21 is at the lock release position, the slide restricting member 21 can be automatically returned to the restriction position merely by starting the usual sheet feeding movement with replacing the feed roller 11 irrespective of attachment and detachment of the sheet feeding cassette.

Next, a third example of the present invention is described.

Figure 11:
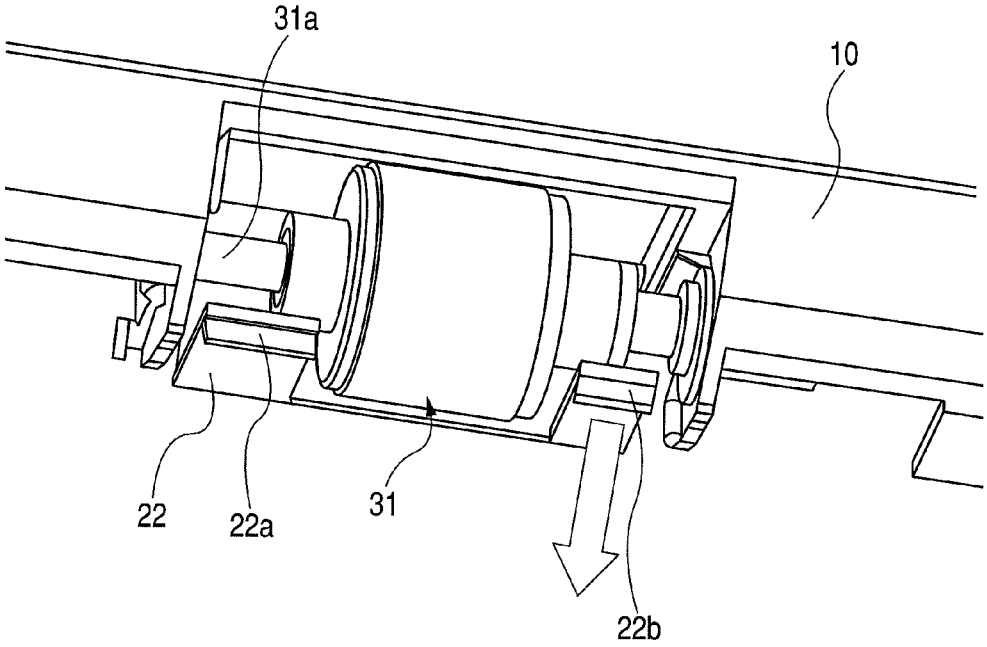
FIG. 11 illustrates a structure of a sheet feeding apparatus according to a third example of the present invention in a vicinity of a feed roller.

FIG. 11 illustrates a structure of a sheet feeding apparatus according to this example in a vicinity of a feed roller.

With reference to FIG. 11, a first roller shaft 31*a* is provided to a feed roller 31 having no cut-away portion. The feed roller 31 is detachable from the sheet feeding frame 10 by expanding and contracting the first roller shaft 31*a*.

A slide restricting member 22 for restricting a slide movement of the feed roller 31 is rotatably held by the sheet feeding frame 10. In this example, the slide restricting member 22 includes projecting portions 22*a* and 22*b* projecting from a bottom toward a side of the feed roller 31.

In the case where the feed roller 31 is replaced, as illustrated in FIG. 11, the user presses down one of the projecting portions 22*a* and 22*b*, for example, the second projecting portion 22*b* on the opposite side of the detachment direction in a direction indicated by an arrow. The slide restricting member 22 overlaps the feed roller 31 in a radial direction until the second projecting portion 22*b* is pushed down. For this reason, the feed roller 31 bumps the slide restricting member 22 and is not detached even when the force in the slide direction is inadvertently exerted on the feed roller 31.

When the second projecting portion 22*b* is pressed down, the slide restricting member 22 is pivoted downward from the restriction position (lock position) for restricting the slide movement of the feed roller 31 to the detachment position (lock release position) for enabling the feed roller 31 to be detached. After that, the slide restricting member 22 is held at the detachment position by the toggle mechanism (not shown) serving as the holding portion, whereby the feed roller 31 can be attached and detached.

Figure 12:
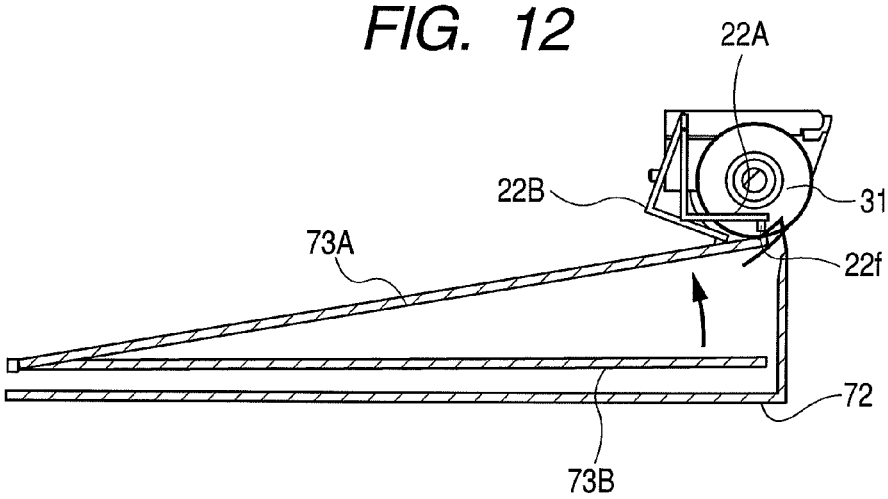
FIG. 12 illustrates a movement of a plate provided between a slide restricting member and a sheet feeding cassette of the sheet feeding apparatus.

When the above-mentioned right door 90 (see FIG. 1) which can be opened and closed is opened, the plate 73 of the cassette 70 is moved to a stand-by position. As illustrated in FIG. 12, the plate 73 is pivoted downward from the sheet feeding possible position 73A, and moved to a stand-by position 73B by a lifting and lowering mechanism (not shown). The plate 73 is pivoted upward when the right door 90 is closed, and moved from the stand-by position 73B to the sheet feeding possible position 73A.

In this example, the slide restricting member 22 is pivoted for return in conjunction with the plate 73 being pivoted upward. Accordingly, a rib 22*f* extending downward is provided at a leading end of the slide restricting member 22. Since the rib 22*f* is provided, when the plate 73 is pivoted upward in conjunction with a closing movement of the right door 90 after the feed roller 31 is mounted and the right door 90 is closed, the plate 73 is pressed against the rib 22*f* from downward. As a result, a force is exerted on the slide restricting member 22 in a direction for pivoting upward.

This force is larger than the holding force of the toggle mechanism, and hence the slide restricting member 22 is pivoted upward, and the slide restricting member 22 is moved to the restriction position. After the movement to the restriction position, the slide restricting member 22 is held at the restriction position by the toggle mechanism, whereby the feed roller 31 is not detached.

In this example, the slide restricting member 22 is pressed by the plate 73 of the sheet feeding cassette 72, which is pivoted upward in conjunction with the closing movement of the right door 90. Accordingly, the slide restricting member 22 can be reliably returned to the restriction position. That is, in this example, the plate 73 is in conjunction with the closing movement of the right door 90, and is moved up while moving the slide restricting member 22 held at the detachment position to the lock position.

Accordingly, when the slide restricting member 22 is at the lock release position, the slide restricting member 22 can be automatically returned to the restriction position merely by starting the usual sheet feeding movement with replacing the feed roller 31 irrespective of attachment and detachment of the sheet feeding cassette.

While the present invention has been described with reference to exemplary embodiments, it is to be understood that the invention is not limited to the disclosed exemplary embodiment. The scope of the following claims is to be accorded the broadest interpretation so as to encompass all such modifications and equivalent structures and functions.

This application claims priority from Japanese Patent Application No. 2008-142497 filed on May 30, 2008, which is hereby incorporated by reference herein.

What is claimed is:

1. A sheet feeding apparatus, comprising:

a feed roller, which includes a roller main body and roller shafts, and which feeds a sheet;

a supporting portion which detachably supports the feed roller in an axial direction, wherein the supporting portion supports the roller shafts of the feed roller in an elastic manner and the feed roller is detached by moving the roller main body along the one axial direction of the roller shafts against elasticity;

a lock member which is movable between a lock position where the detachment of the feed roller is restricted and a lock release position where the detachment of the feed roller is allowed, wherein the lock member includes a restricting member which is provided on a side of a detachment direction of the feed roller and the restricting member restricts a movement of the roller main body along the one axial direction of the roller shafts;

a holding portion which holds the lock member that has moved to the lock release position, the holding portion holding the lock member that has moved along with the movement of the roller main body in the one axial direction;

a fixing portion which fixes the lock member held by the holding member; and a moving mechanism which releases a fix of the lock member by the fixing portion and moves the lock member held at the lock release position by the holding portion to the lock position in conjunction with a mounting operation of the feed roller when the feed roller is mounted on the supporting portion by moving of the roller main body in an opposite direction with the one axial direction.

2. A sheet feeding apparatus according to claim 1, wherein the moving mechanism includes:

an engagement portion which is provided on the lock member; and an abutment portion which is provided on the feed roller, when the feed roller is mounted on the supporting portion, the abutment portion abuts against the engagement portion and moves the lock member held at the lock release position to the lock position.

3. A sheet feeding apparatus according to claim 1, wherein the roller shafts includes a first roller shaft and a second roller shaft and the roller main body is movable along the first roller shaft and is integrally provided with the second roller shaft; and wherein the roller main body is moved along the first roller shaft to a position where the second roller shaft is released from the supporting portion when the feed roller is detached.

4. A sheet feeding apparatus according to claim 3, wherein the lock member moves to the lock release position by a manual operation, and moves, to a position where the lock member is held by the holding portion, along with the movement of the roller main body.

5. An image forming apparatus having a sheet feeding apparatus which feeds a sheet, and an image forming portion which forms an image on the sheet fed from the sheet feeding apparatus, the sheet feeding apparatus comprising:

a feed roller, which includes a roller main body and roller shafts, and which feeds a sheet:

a supporting portion which detachably supports the feed roller in an axial direction, wherein the supporting portion supports the roller shafts of the feed roller in an elastic manner and the feed roller is detached by moving the roller main body along the one axial direction of the roller shafts against elasticity;

a lock member which is movable between a lock position where the detachment of the feed roller is restricted and a lock release position where the detachment of the feed roller is allowed, wherein the lock member includes a restricting member which is provided on a side of a detachment direction of the feed roller and the restricting member restricts a movement of the roller main body along the one axial direction of the roller shafts;

a holding portion which holds the lock member that has moved to the lock release position, the holding portion holding the lock member that has moved along with the movement of the roller main body in the one axial direction;

a fixing portion which fixes the lock member held by the holding member; and a moving mechanism which releases a fix of the lock member by the fixing portion and moves the lock member held at the lock release position by the holding portion to the lock position in conjunction with a mounting operation of the feed roller when the feed roller is mounted on the supporting portion by moving of the roller main body in an opposite direction with the one axial direction.

6. An image forming apparatus according to claim 5, wherein the moving mechanism includes:

an engagement portion which is provided on the lock member; and an abutment portion which is provided on the feed roller, when the feed roller is mounted on the supporting portion, the abutment portion abuts against the engagement portion and moves the lock member held at the lock release position to the lock position.

7. An image forming apparatus according to claim 5, wherein the roller shafts includes a first roller shaft and a second roller shaft and the roller main body is movable along the first roller shaft and is integrally provided with the second roller shaft; and wherein the roller main body is moved along the first roller shaft to a position where the second roller shaft is released from the supporting portion when the feed roller is detached.

8. An image forming apparatus according to claim 7, wherein the lock member moves to the lock release position by a manual operation, and moves, to a position where the lock member is held by the holding portion, along with the movement of the roller main body.

* * * * *